US009759459B2

(12) United States Patent
Hiratsuka

(10) Patent No.: US 9,759,459 B2
(45) Date of Patent: Sep. 12, 2017

(54) REGENERATOR AND REGENERATIVE REFRIGERATOR WITH INSERTION MEMBER

(71) Applicant: Sumitomo Heavy Industries, Ltd., Tokyo (JP)

(72) Inventor: Yoshikatsu Hiratsuka, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 238 days.

(21) Appl. No.: 14/610,205

(22) Filed: Jan. 30, 2015

(65) Prior Publication Data

US 2015/0219369 A1 Aug. 6, 2015

(30) Foreign Application Priority Data

Jan. 31, 2014 (JP) ..... 2014-017385

(51) Int. Cl.
*F25B 25/02* (2006.01)
*F25B 15/00* (2006.01)
*F25B 9/14* (2006.01)

(52) U.S. Cl.
CPC ..... *F25B 25/02* (2013.01); *F25B 9/14* (2013.01); *F25B 15/00* (2013.01); *F02G 2243/22* (2013.01); *F02G 2257/00* (2013.01); *F02G 2258/80* (2013.01); *F25B 2309/003* (2013.01)

(58) Field of Classification Search
CPC ..... F25B 9/14; F25B 2309/003; F25B 2309/1415; F25B 2309/1416; F02G 2243/22; F02G 2257/00; F02G 2258/80; F04B 37/085
See application file for complete search history.

(56) References Cited

U.S. PATENT DOCUMENTS 9,423,160 B2 * 8/2016 Xu ..... F25B 9/14
2008/0104967 A1 * 5/2008 Satoh ..... C09K 5/14 62/6
2014/0020407 A1 * 1/2014 Xu ..... F25B 9/14 62/6
2015/0276274 A1 * 10/2015 Xu ..... F25B 21/00 62/3.1

FOREIGN PATENT DOCUMENTS

JP 2008-224161 A 9/2008

* cited by examiner

*Primary Examiner* — Christopher R Zerphey
(74) *Attorney, Agent, or Firm* — Michael Best & Friedrich LLP

(57) ABSTRACT

A regenerator accumulates cooling generated by expansion of refrigerant gas, and the regenerator includes a regenerator material which is made of a nonmagnetic material, a regenerator material which is made of a magnetic material, a container which includes a high temperature end and a low temperature end, and which accommodates the regenerator material made of the nonmagnetic material at the high temperature end side and the regenerator material made of the magnetic material at the low temperature end side. The container further accommodates an insertion member which narrows a passage area of the refrigerant gas flowing to a region accommodating the refrigerator material made of the magnetic material so that the passage area of the low temperature end side is narrower compared to the passage area of the high temperature end side.

8 Claims, 5 Drawing Sheets

REGENERATOR AND REGENERATIVE REFRIGERATOR WITH INSERTION MEMBER

RELATED APPLICATIONS

Priority is claimed to Japanese Patent Application No. 2014-017385, filed Jan. 31, 2014, the entire content of which is incorporated herein by reference.

BACKGROUND

Technical Field

Certain embodiments of the present invention relate to a regenerator which accumulates cooling generated by Simon expansion of a high pressure refrigerant gas supplied from a compression apparatus, and a regenerative refrigerator including the regenerator.

Description of Related Art

In some displacer type regenerative refrigerators, a displacer reciprocates in an inner portion of a cylinder, and thus, a refrigerant gas in an expansion space is expanded and cooling is generated. Moreover, in a pulse tube type regenerative refrigerator, a gas piston reciprocates in a pulse tube, and thus, a refrigerant gas in an expansion space is expanded and cooling is generated. The cooling of the refrigerant gas generated in the expansion space is accumulated in the regenerator, and cools a cooling object connected to the cooling stage. In addition, for example, as the refrigerant gas, helium gas is used.

A regenerator material is used in the regenerator. For example, in a cryogenic temperature region of 10 K or less, specific heat of a regenerator material made of a nonmagnetic material such as copper is lower than that of the helium gas which is the refrigerant gas. Accordingly, in the regenerator in the cryogenic temperature region, a regenerator material made of a magnetic material having higher specific heat in the temperature region is used.

SUMMARY

According to an embodiment of the present invention, there is provided a regenerator which accumulates cooling generated by expansion of refrigerant gas, including: a regenerator material which is made of a nonmagnetic material; a regenerator material which is made of a magnetic material; and a container which includes a high temperature end and a low temperature end, and which accommodates the regenerator material made of the nonmagnetic material at the high temperature end side and the regenerator material made of the magnetic material at the low temperature end side. The container further accommodates an insertion member which narrows a passage area of the refrigerant gas flowing to a region accommodating the regenerator material made of the magnetic material so that the passage area of the low temperature end side is narrower compared to the passage area of the high temperature end side.

DETAILED DESCRIPTION

In general, a regenerator material made of a magnetic material is more expensive than a regenerator material made of a nonmagnetic material. Accordingly, from the viewpoint of reducing in costs of a regenerator and a regenerative refrigerator having the regenerator, it is desirable to provide a technique which decreases a used amount of the regenerator material while maintaining the cooling performance of the regenerative refrigerator.

Hereinafter, an embodiment of the present invention will be described with reference to the drawings.

Before a regenerator according to an embodiment of the present invention is described, a regenerative refrigerator using the regenerator according to the embodiment will be described.

Figure 1:
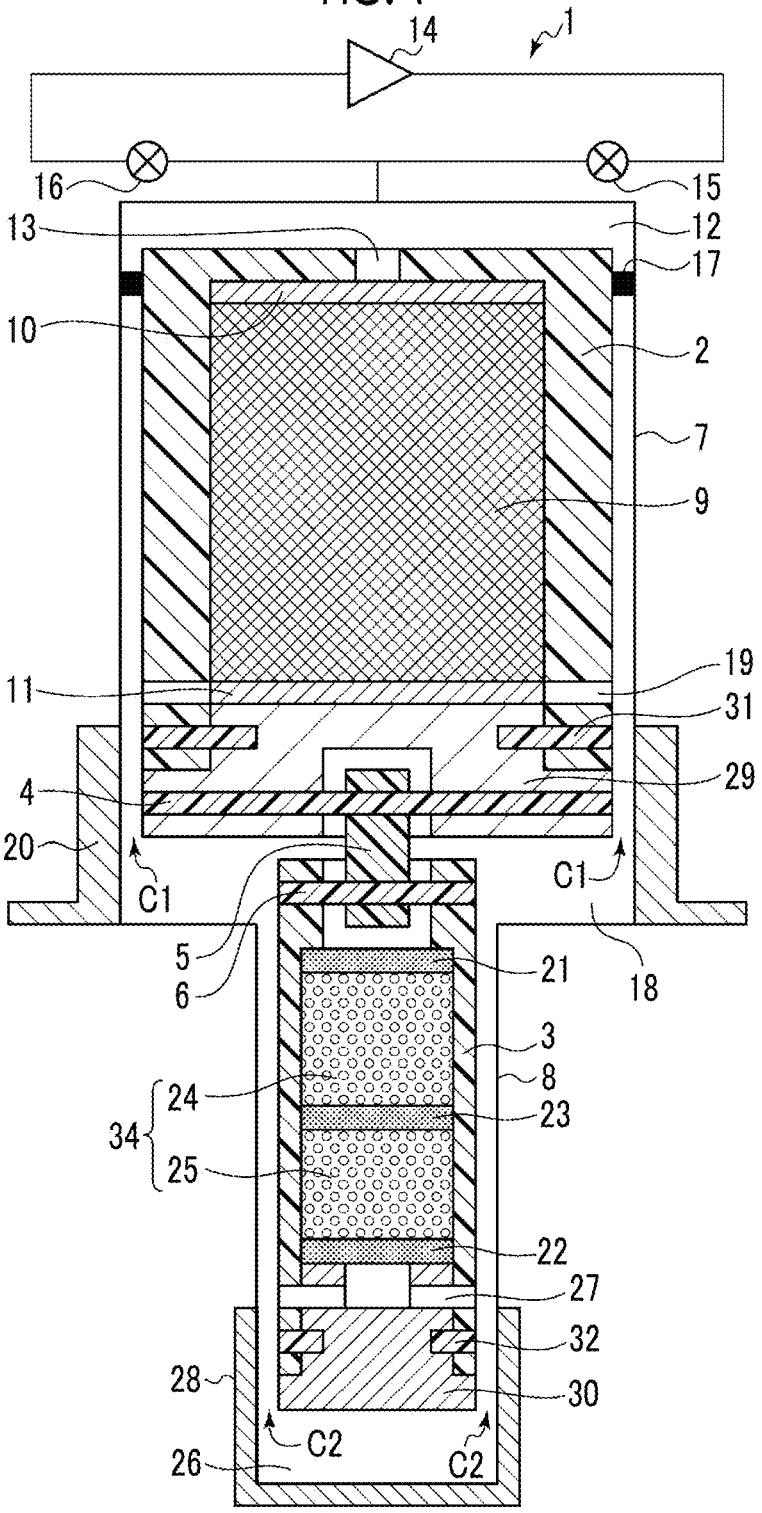
FIG. 1 is a diagram schematically showing an example of a regenerative refrigerator according to an embodiment.

FIG. 1 is a diagram schematically showing an example of a regenerative refrigerator 1 according to an embodiment. For example, the regenerative refrigerator 1 according to the embodiment is the Gifford McMahon (GM) type cryogenic temperature refrigerator using helium gas as the refrigerant gas. As shown in FIG. 1, the regenerative refrigerator 1 includes a first displacer 2, and a second displacer 3 which is connected to the first displacer 2 in a longitudinal direction. For example, the first displacer 2 and the second displacer 3 are connected to each other via a pin 4, a connector 5, and a pin 6.

A first cylinder 7 and a second cylinder 8 are integrally formed, and respectively include a high temperature end and a low temperature end. The low temperature end of the first cylinder 7 and the high temperature end of the second cylinder 8 are connected to each other at a lower portion of the first cylinder 7. The second cylinder 8 is formed to substantially coaxially extend with the first cylinder 7, and is a cylindrical member having a smaller diameter than that of the first cylinder 7. The first cylinder 7 is a container which accommodates the first displacer 2 to be reciprocated in the longitudinal direction. In addition, the second cylinder 8 is a container which accommodates the second displacer 3 to be reciprocated in the longitudinal direction.

Considering strength, thermal conductivity, helium shut-off capacity, or the like, for example, the first cylinder 7 and the second cylinder 8 may be made of stainless steel. A metal cylinder such as stainless steel may be formed on an outer circumferential portion of the second displacer 3. An abrasion resistant resin film such as fluororesin may be formed on the outer circumferential surface of the second displacer 3.

A scotch yoke mechanism (not shown) which reciprocates the first displacer 2 and the second displacer 3 is provided on the high temperature end of the first cylinder 7. The first displacer 2 and the second displacer 3 respectively reciprocate along the first cylinder 7 and the second cylinder 8. The first displacer 2 and the second displacer 3 respectively include a high temperature end and a low temperature end.

The first displacer 2 includes a cylindrical outer circumferential surface, and an inner portion of the first displacer 2 is filled with a first regenerator material. An internal volume of the first displacer 2 functions as a first regenerator 9. A flow straightener 10 is installed on an upper portion of the first regenerator 9, and a flow straightener 11 is installed on a lower portion of the first regenerator 9. A first opening 13, which causes the refrigerant gas to circulate from a room temperature chamber 12 to the first displacer 2, is formed on the high temperature end of the first displacer 2.

The room temperature chamber 12 is a space which is formed by the first cylinder 7 and the high temperature end of the first displacer 2. The volume of the room temperature chamber 12 is changed according to the reciprocating of the first displacer 2. Among pipes which connect intake and exhaust systems configured of a compressor 14, a supply valve 15, and a return valve 16 to one another, a supply and exhaust common pipe is connected to the room temperature chamber 12. Moreover, a seal 17 is mounted between a portion from the high temperature end of the first displacer 2 and the first cylinder 7.

A second opening 19 which introduces the refrigerant gas to a first expansion space 18 via a first clearance C1 is formed on the low temperature end of the first displacer 2. The first expansion space 18 is a space which is formed by the first cylinder 7 and the first displacer 2. The volume of the first expansion space 18 is changed because of the reciprocating of the first displacer 2. A first cooling stage 20 which is thermally connected to a cooling object (not shown) is disposed at a position corresponding to the first expansion space 18 of the outer circumference of the first cylinder 7. The first cooling stage 20 is cooled by the refrigerant gas passing through the first clearance C1.

The second displacer 3 includes a cylindrical outer circumferential surface. An upper end flow straightener 21, a lower end flow straightener 22, and a retainer 23 which is positioned at the intermediate position between the upper end flow straightener and the lower end flow straightener are provided in an inner portion of the second displacer 3, and the inner portion is divided into two steps in the axial direction while interposing the retainer. In the internal volume of the second displacer 3, for example, a high temperature side region 24 which is a temperature side higher than the retainer 23 is filled with a second regenerator material made of a nonmagnetic material such as lead or bismuth. A low temperature side region 25 which is a low temperature side (low step) of the retainer 23 is filled with a third regenerator material made of a magnetic material such as $HoCu_2$ which is different from the high temperature side region 24. The lead, bismuth, $HoCu_2$, or the like is formed in a spherical shape, and a plurality of spherical formations are collected and thus, the regenerator material is configured. The retainer 23 prevents the regenerator material of the high temperature side region 24 and the regenerator material of the low temperature side region 25 from being mixed. The high temperature side region 24 and the low temperature side region 25 which are the internal volumes of the second displacer 3 function as the second regenerator 34. The first expansion space 18 and the high temperature end of the second displacer 3 communicate with each other via a communication path around the connector 5. The refrigerant gas circulates from the first expansion space 18 to the second regenerator 34 via the communication path.

A third opening 27 for circulating the refrigerant gas to a second expansion space 26 via a second clearance C2 is formed on the low temperature end of the second displacer 3. The second expansion space 26 is a space which is formed by the second cylinder 8 and the second displacer 3. The volume of the second expansion space 26 is changed because of the reciprocating of the second displacer 3. The second clearance C2 is formed by the low temperature end of the second cylinder 8 and the second displacer 3.

A second cooling stage 28 which is thermally connected to the cooling object is disposed at a position corresponding to the second expansion space 26 of the outer circumference of the second cylinder 8. The second cooling stage 28 is cooled by the refrigerant gas passing through the second clearance C2.

From the viewpoint of specific weight, strength, thermal conductivity, or the like, for example, a fabric based phenol resin is used for the first displacer 2. For example, the first regenerator material is configured of wire mesh or the like. Moreover, for example, the second displacer 3 is configured by holding the spherical second regenerator material such as lead or bismuth in the axial direction with a felt or the wire mesh. Moreover, as described above, the internal volume of the second displacer 3 may be divided into a plurality of regions by the retainers.

The first displacer 2 and the second displacer 3 may respectively include a cover portion 29 and a cover portion 30 at the low temperature ends. From the viewpoint of joining with the displacer main bodies, the cover portion 29 and the cover portion 30 have two-stepped columnar shapes. The cover portion 29 is fixed to the first displacer 2 by a press-fitting pin 31, and the cover portion 30 is fixed to the second displacer 3 by the press-fitting pin 32. Accordingly, in both the first cooling stage 20 and the second cooling stage 28, a substantial heat exchange area is increased, and thus, cooling performance is increased.

Next, an operation of the regenerative refrigerator 1 according to the embodiment will be described. At a time point of a refrigerant gas supply process, the first displacer 2 and the second displacer 3 are positioned at bottom dead centers of the first cylinder 7 and the second cylinder 8. Simultaneously with this, or at a slightly deviated timing, if the supply valve 15 is opened, a high pressure helium gas (for example, helium gas of 2.2 MPa) is supplied into the first cylinder 7 via the supply valve 15 from the supply and exhaust common pipe, and flows into the first regenerator 9 inside the first displacer 2 from the first opening 13 disposed on the upper portion of the first displacer 2. The high pressure helium gas flowing into the first regenerator 9 is supplied to the first expansion space 18 via the second opening 19 and the first clearance C1 positioned at the lower portion of the first displacer 2 while being cooled by the first regenerator material.

The high pressure helium gas supplied to the first expansion space 18 flows into the second regenerator 34 inside the second displacer 3 via the communication path around the connector 5. The high pressure helium gas flowing into the second regenerator 34 is supplied to the second expansion space 26 via the third opening 27 and the second clearance positioned at the lower portion of the second displacer 3 while being cooled by the second regenerator material.

In this way, the first expansion space 18 and the second expansion space 26 are filled with the high pressure helium gas, and the supply valve 15 is closed. At this time, the first displacer 2 and the second displacer 3 are positioned at top dead centers of the first cylinder 7 and the second cylinder 8. Simultaneously with this, or at a slightly deviated timing, if the return valve 16 is opened, the refrigerant gas in the first expansion space 18 and the second expansion space 26 is expanded, and thus, becomes a low pressure helium gas (for example, helium gas of 0.8 MPa). At this time, cooling is generated by the expansion of the refrigerant gas. The helium gas of the first expansion space 18 becoming a low temperature by the expansion absorbs heat of the first cooling stage 20 via the first clearance C1. Moreover, the helium gas of the second expansion space 26 absorbs heat of the second cooling stage 28 via the second clearance C2.

The first displacer 2 and the second displacer 3 move toward the bottom dead centers, and the volumes of the first expansion space 18 and the second expansion space 26 are decreased. The helium gas inside the second expansion space 26 is returned to the first expansion space 18 via the second clearance C2, the third opening 27, the second regenerator 34, and the communication path. Moreover, the helium gas inside the first expansion space 18 is returned to the intake side of the compressor 14 via the second opening 19, the first regenerator 9, and the first opening 13. At this case, the first regenerator material, the second regenerator material, and the third regenerator material are cooled by the refrigerant gas. That is, the first regenerator material, the second regenerator material, and the third regenerator material accumulate cooling generated by the expansion of the refrigerant gas. This process becomes one cycle, the first cooling stage 20 and the second cooling stage 28 are cooled by repeating the cooling cycle.

Next, an internal configuration of the second regenerator 34 according to the embodiment will be described in more detail.

As described above, the cooling cycle in the regenerative refrigerator 1 includes an operation which repeats the flowing of the helium gas which is the refrigerant gas into and out of the second regenerator. Hereinafter, a temperature profile and a mass change of the helium gas existing in the second regenerator 34 will be described.

Figure 2:
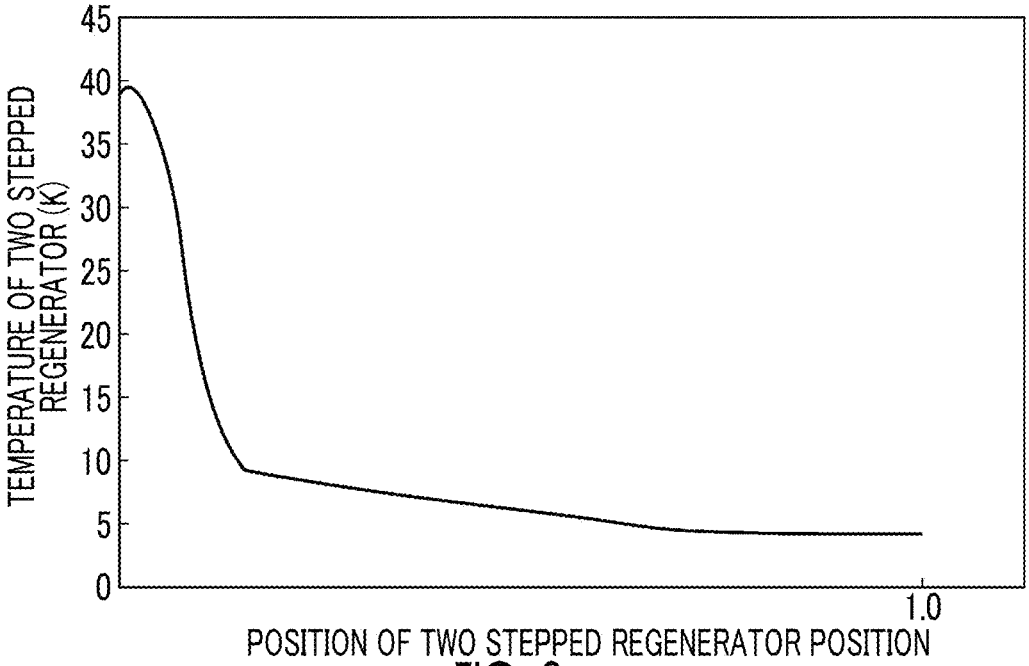
FIG. 2 is a graph showing an example of a temperature profile of a second regenerator according to the embodiment.

FIG. 2 is a graph showing an example of the temperature profile of the second regenerator 34 according to the embodiment, and is a graph showing the temperature profile of the second regenerator 34 when the distance from the high temperature end of the second regenerator to the low temperature end is normalized as 1. As shown in FIG. 2, the temperature profile of the second regenerator 34 is not linearly decreased from the high temperature end toward the low temperature end. As shown in FIG. 2, the temperature in the high temperature end (the normalized distance is 0) of the second regenerator 34 is approximately 40 K, and the temperature of the low temperature end (normalized distance is 1) is approximately 5 K. The temperature profile of the second regenerator 34 is decreased until the temperature is approximately 10 K around 0.2 by the normalized distance from the high temperature end, and the temperature is decreased to approximately 5 K until the normalized distance is ⅔ to ¾.

In this way, in the second regenerator 34, there is almost no temperature gradient in a region from the low temperature end to ¼ to ⅓ by the normalized distance. Accordingly, even when the regenerator material is decreased in the region from the low temperature end to ¼ to ⅓ by the normalized distance, it is considered that the cooling performance is not decreased. In addition, in the region from the low temperature end to ¼ to ⅓ by the normalized distance, the temperature is around 5 K, and the region is filled with the third regenerator material made of a magnetic material such as $HoCu_2$. Hereinafter, a relationship between mass distribution and cooling capacity of the refrigerant gas in the second regenerator 34 will be described.

Figure 3:
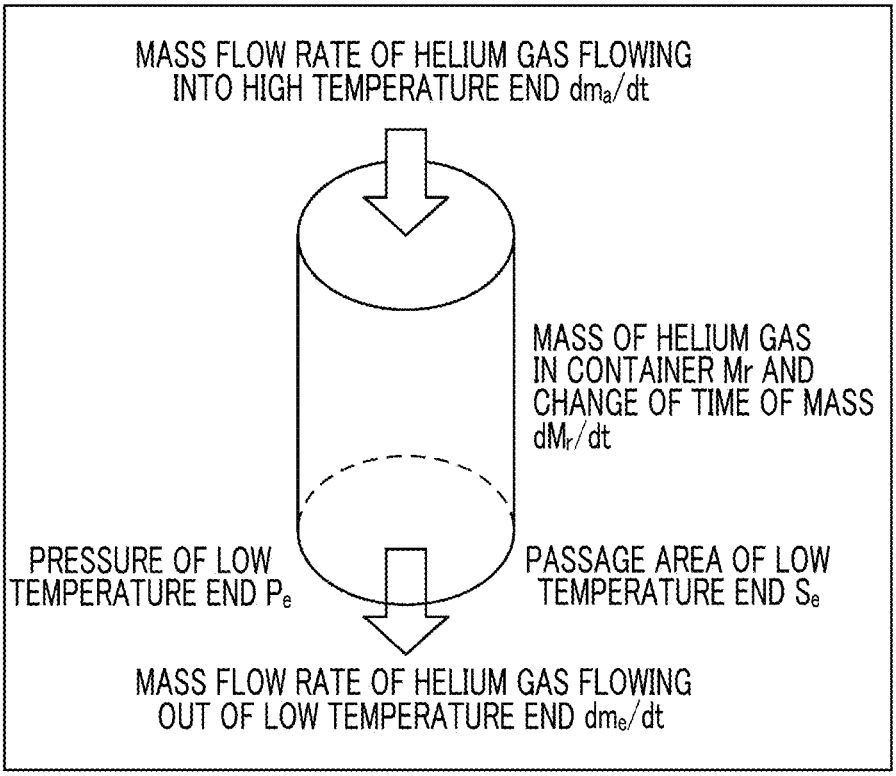
FIG. 3 is a diagram for illustrating mass distribution of refrigerant gas in the second regenerator.

FIG. 3 is a diagram for illustrating the mass distribution of the refrigerant gas in the second regenerator 34. The mass of the helium gas existing in the second regenerator 34 is defined as $M_r$, and a change amount per unit time is defined as $dM_r/dt$. Moreover, a mass flow rate of the helium gas which flows into the high temperature end of the second regenerator 34 is defined as $dm_a/dt$, and a mass flow rate of the helium gas which flows out of the low temperature end is defined as $dm_e/dt$. In this case, the following Expression is satisfied.

$$dm_e/dt=dm_a/dt-dM_r/dt \quad (1)$$

Moreover, $dm_a/dt$ indicates a time differential of the mass $m_a$ of the helium gas in the high temperature end of the second regenerator 34. Similarly, $dm_e/dt$ indicates a time differential of the mass $m_e$ of the helium gas in the low temperature end of the second regenerator 34.

The volume of the second regenerator 34 is defined as V, and an average density of the helium gas in the second regenerator 34 is defined as ρ. If it is assumed that the volume of the second regenerator 34 is constant, the mass $M_r$ of the helium gas existing in the second regenerator 34 becomes $$M_r=V\rho \quad (2).$$

If the Expression (2) is substituted into the Expression (1), the following Expression is obtained.

$$dm_e/dt=dm_a/dt-Vd\rho/dt \quad (3)$$

As is well known, the density of the helium gas in a cryogenic temperature region is largely dependent on the pressure. For example, the density of the helium gas of 2.2 MPa is 160 kg/m$^3$ when the temperature is 5 K while the density is approximately 40 kg/m$^3$ when the temperature is 25 K. Accordingly, the helium gas flowing from the high temperature end of the second regenerator 34 is gradually cooled as it flows toward the low temperature end, and the density of the helium gas is increased. That is, in the Expression (3), $Vd\rho/dt>0$ is satisfied. From the above, the following Expression (4) is obtained.

$$dm_e/dt>dm_a/dt \quad (4)$$

The Expression (4) indicates that the mass flow rate of the helium gas flowing out of the low temperature end of the second regenerator 34 is smaller than the mass flow rate of the helium gas flowing into the high temperature end.

The pressure of the helium gas in the low temperature end of the second regenerator 34 is defined as $P_e$. In the refrigerant gas supply process, since the high pressure helium gas is supplied from the compressor 14, the helium gas in the second expansion space 26 is isobarically expanded. When the helium gas is increased by a fine volume dV, work $w_e$ done by the helium gas is obtained by the following Expression (5).

$$w_e=P_e dV \quad (5)$$

Moreover, cooling generated in the second expansion space 26 is increased as the work $w_e$ done by the helium gas in the second expansion space 26 is increased.

Here, the helium gas of a mass M flows out of the low temperature end of the second regenerator 34, and thus, the helium gas is increased by the fine volume dV. In this case, $\rho dV=dM$ is satisfied. dM is a mass increase of the helium gas in the second expansion space 26. That is, this is generated due to the helium gas which flows out of the low temperature end of the second regenerator 34. From the above, the following Expression (6) is obtained.

$$w_e=P_e/\rho\times dm_e \quad (6)$$

In addition, the pressure $P_e$ of the helium gas in the low temperature end of the second regenerator 34 is a value which is obtained by dividing a force f operating at the low temperature end of the second regenerator 34 by a passage area $S_e$ of the low temperature end of the second regenerator 34. That is, $$P_e=f/S_e \tag{7}$$

is satisfied.

If the Expression (7) is substituted into the Expression (6), the following Expression (8) is obtained.

$$w_e=P_e/(\rho\times S_e)\times dm_e \tag{8}$$

The Expression (8) indicates that the work $w_e$ done by the helium gas in the second expansion space 26 is proportional to the mass $dm_e$ of the helium gas flowing out of the low temperature end of the second regenerator 34 and is inversely proportional to the passage area $S_e$ of the low temperature end of the second regenerator 34.

When the above matters are arranged, at least the following matters are derived from the Expressions (4) and (8).

(a) The mass flow rate of the helium gas flowing out of the low temperature end of the second regenerator 34 is smaller than the mass flow rate of the helium gas flowing into the high temperature end of the second regenerator 34.

(b) The work $w_e$ done by the helium gas in the second expansion space 26 is proportional to the mass $dm_e$ of the helium gas flowing out of the low temperature end of the second regenerator 34.

(c) The work $w_e$ done by the helium gas in the second expansion space 26 is inversely proportional to the passage area $S_e$ of the low temperature end of the second regenerator 34.

(a) suggests that since the mass flow rate $dm_e/dt$ of the helium gas in the vicinity of the low temperature end of the second regenerator 34 is small, that is, enthalpy which flows in is small, heat quantity which should be accumulated may be decreased. This suggests a possibility that the regenerator material in the vicinity of the low temperature end of the second regenerator 34 may be decreased.

(b) suggests that if the mass flow rate $dm_e/dt$ of the helium gas in the vicinity of the low temperature end of the second regenerator 34 is decreased, the work $w_e$ done by the helium gas in the second expansion space 26 is also decreased. Meanwhile, (c) suggests a possibility that even when the mass flow rate of the helium gas in the vicinity of the low temperature end of the second regenerator 34 is decreased, the decreased amount of the work $w_e$ may be offset by decreasing the passage area $S_e$ of the low temperature end of the second regenerator 34. It may be possible to at least prevent the work $w_e$ from being largely decreased. This is because even when the mass flow rate $dm_e/dt$ of the helium gas is decreased, since a pressure amplitude is increased by decreasing the passage area $S_e$ of the low temperature end of the second regenerator 34, it is possible to maintain the workload.

Based on the above, the second regenerator 34 according to the embodiment accommodates an insertion member in which the passage area of the helium gas flowing to the region accommodating the third regenerator made of a magnetic material is changed so that the passage area of the low temperature end side is narrower compared to the passage area of the high temperature end side.

FIGS. 4A to 4D are diagrams schematically showing an insertion member 35 which is accommodated into the second regenerator 34 according to the embodiment. More specifically, FIGS. 4A to 4D are cross-sectional diagrams taken along a plane including a long axis of the second regenerator 34 in a state where the second regenerator 34 accommodates the insertion member 35.

Figure 4A:
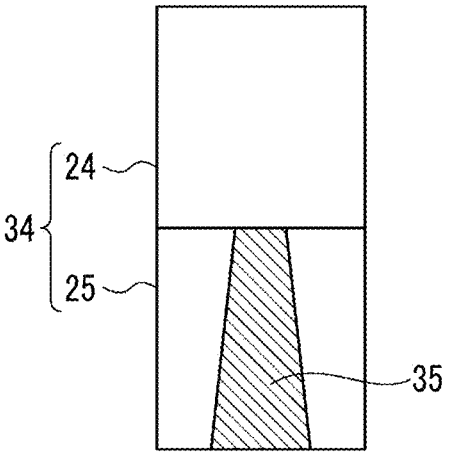
FIGS. 4A to 4D are diagrams schematically showing an insertion member which is accommodated into the second regenerator according to the embodiment.

FIG. 4A shows the insertion member 35 which is configured so that an area of a cross section perpendicular to the long axis is continuously increased from one end to the other end. FIG. 4A shows the insertion member 35 which has a trapezoid shape in which the slopes of the cross section parallel to the long axis are linear from the one end toward the other end. In addition, the slopes may be curved from the one end toward the other end.

As shown in FIG. 4A, the insertion member 35 is inserted into the region (the above-described low temperature side region 25) which accommodates the third regenerator material made of a magnetic material in the second regenerator 34 so that the one end is the high temperature side of the second regenerator 34 and the other end is the low temperature side of the second regenerator 34. Accordingly, compared to before the insertion member 35 is accommodated, the volume of the space accommodating the third regenerator material made of the magnetic material in the second regenerator 34 is decreased. Therefore, the amount of the third regenerator material made of the magnetic material to fill the second regenerator 34 is also decreased.

In addition, with respect to the passage area of the helium gas of the low temperature side region 25 which accommodates the third regenerator material made of the magnetic material in the second regenerator 34, compared to the high temperature end side, the low temperature end side is narrower. Accordingly, it is possible to increase the pressure amplitude of the helium gas in the low temperature end of the second regenerator 34. As a result, compared to before the insertion member 35 is inserted into the second regenerator 34, it is possible to increase the work $w_e$ done by the helium gas in the second expansion space 26.

Figure 4B:
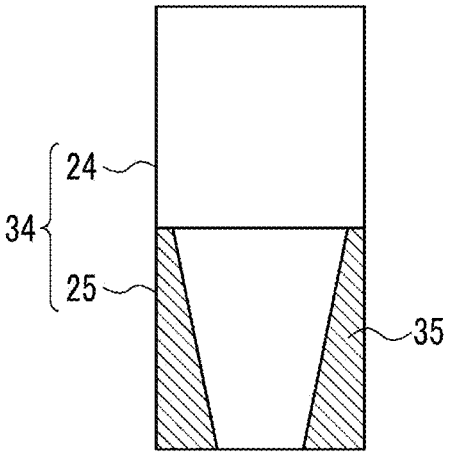

FIG. 4B is a diagram showing another aspect of the insertion member 35. The insertion member 35 shown in FIG. 4B is a tubular member having a passage in which the passage area is continuously decreased from the one end toward the other end. In addition, FIG. 4B shows a case where the cross section of the passage is formed so that the slopes are linear from the one end toward the other end. However, the slopes may be curved from the one end toward the other end.

As shown in FIG. 4B, the insertion member 35 is fitted to and inserted into the low temperature side region 25 which accommodates the third regenerator material made of the magnetic material so that the one end is the high temperature side of the second regenerator 34 and the other end is the low temperature side of the second regenerator 34. In addition, the third regenerator material made of the magnetic material is accommodated in the passage which is provided in the insertion member 35. Accordingly, compared to before the insertion member 35 is accommodated, the volume of the space accommodating the third regenerator material made of the magnetic material in the second regenerator 34 is decreased. Therefore, the amount of the third regenerator material made of the magnetic material to fill the second regenerator 34 is also decreased.

In addition, similar to the case shown in FIG. 4A, with respect to the passage area of the helium gas of the region which accommodates the third regenerator material made of the magnetic material in the second regenerator 34, compared to the high temperature end side, the low temperature end side is narrower. Accordingly, it is possible to increase the pressure amplitude of the helium gas in the low temperature end of the second regenerator 34. As a result, compared to before the insertion member 35 is inserted into the second regenerator 34, it is possible to increase the work $w_e$ done by the helium gas in the second expansion space 26.

Therefore, a decrease in freezing performance is prevented, and it is possible to maintain the freezing performance.

Figure 4C:
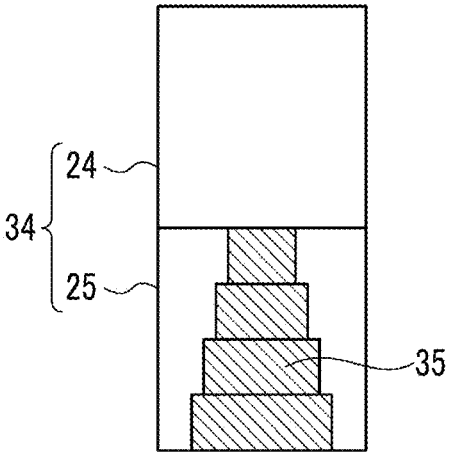

FIG. 4C is a diagram showing still another aspect of the insertion member 35. The insertion member 35 shown in FIG. 4C is configured so that the cross-sectional area is increased in stages from one end toward the other end. Different from the insertion member 35 shown in FIG. 4A, in the insertion member 35 shown in FIG. 4C, the cross-sectional area is not continuously increased from the one end toward the other end. Meanwhile, similar to the insertion member 35 shown in FIG. 4A, also in the insertion member shown in FIG. 4C, the insertion member 35 is inserted into the low temperature side region 25 which accommodates the third regenerator material made of the magnetic material in the second regenerator 34 so that the one end is the high temperature side of the second regenerator 34 and the other end is the low temperature side of the second regenerator 34. The effects also are similar to those of the insertion member 35 shown in FIG. 4A.

Figure 4D:
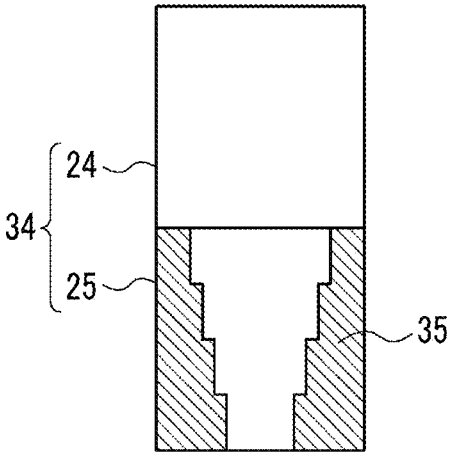

FIG. 4D is a diagram showing still another aspect of the insertion member 35. The insertion member 35 shown in FIG. 4D is a tubular member having a passage in which the passage area is decreased in stages from one end toward the other end. Different from the insertion member 35 shown in FIG. 4B, in the insertion member 35 shown in FIG. 4D, the passage area is not continuously decreased. Meanwhile, similar to the insertion member 35 shown in FIG. 4B, also in the insertion member shown in FIG. 4D, the insertion member 35 is fitted and inserted into the low temperature side region 25 which accommodates the third regenerator material made of the magnetic material in the second regenerator 34 so that the one end is the high temperature side of the second regenerator 34 and the other end is the low temperature side of the second regenerator 34. The effects also are similar to those of the insertion member 35 shown in FIG. 4B.

In all examples shown in FIGS. 4A to 4D, the insertion member 35 is inserted into the existing second regenerator 34, and thus, it is possible to maintain the freezing performance while decreasing the third regenerator material made of the magnetic material to fill the second regenerator 34. Since the existing second regenerator 34 can be used, it is possible to decrease a manufacturing cost of the regenerative refrigerator. In addition, in all insertion members 35 shown in FIGS. 4A to 4D, the existing fabric based phenol resin or the like can be used.

In addition, in FIGS. 4B and 4D, the insertion member 35 is fitted and inserted, and thus, the passage area of the third regenerator material made of the magnetic material in the second regenerator 34 is changed. Instead of this, the shape of the container itself accommodating the third regenerator material made of the magnetic material in the second regenerator 34 may be changed. Specifically, with respect to the shape of the container itself accommodating the third regenerator material made of the magnetic material in the second regenerator 34, FIG. 4B or FIG. 4D may be changed to have the passage area after the insertion member is inserted.

FIGS. 4A to 4D are diagrams showing examples when the insertion member 35 is a single member. The insertion member 35 is not limited to the single member, and may be configured of a plurality of members. Hereinafter, this case will be described.

Figure 5A:
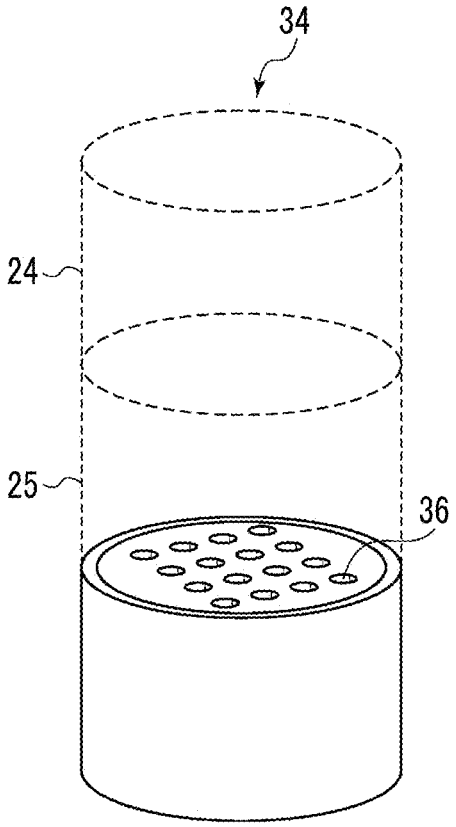
FIGS. 5A and 5B are diagrams schematically showing an insertion member configured of a plurality of members which are accommodated into the second regenerator according to the embodiment.
Figure 5B:
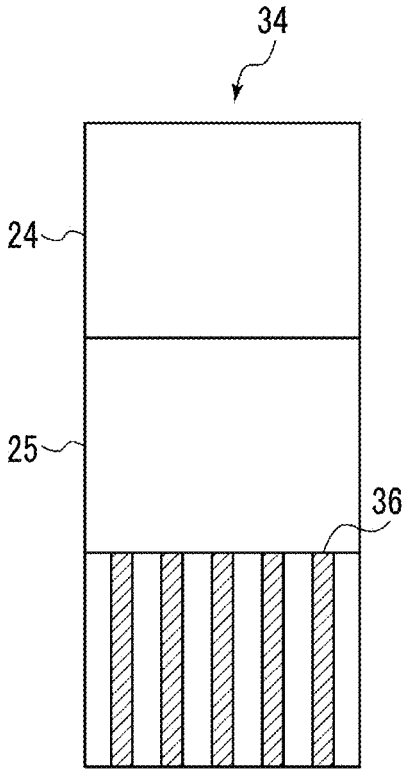

FIGS. 5A and 5B are diagrams schematically showing the insertion member 35 configured of a plurality of members which are accommodated into the second regenerator 34 according to the embodiment. More specifically, FIG. 5A is a perspective diagram of the second regenerator 34 showing a state where the insertion member 35 configured a plurality of members is inserted. In addition, FIG. 5B is a cross-sectional diagram of the second regenerator 34 shown in FIG. 5A taken along the plane including the long axis.

The insertion member 35 shown in FIGS. 5A and 5B is configured of a plurality of thin walled tubes 36. That is, the plurality of thin walled tubes 36 are matched to one another, and thus, function as one insertion member 35. Here, an inner diameter of each thin walled tube 36 is less than 1 mm, and preferably, is approximately 0.3 mm. In addition, a length in a long axis direction of each thin walled tube 36 is shorter than the length in the long axis direction of the low temperature side region 25 accommodating the regenerator material made of the magnetic material in the second regenerator 34. The plurality of thin walled tubes 36 are accommodated to be distributed in the low temperature side in the low temperature side region 25 accommodating the regenerator material made of the magnetic material in the second regenerator 34.

Here, "accommodated to be distributed" means that the plurality of thin walled tubes 36 are accommodated to be distributed in the direction perpendicular to the long axis of the second regenerator 34 while each long axis of the plurality of thin walled tubes 36 is parallel to the long axis of the second regenerator 34. Accordingly, as shown in FIG. 5B, the passage area of the helium gas of the low temperature side region 25 in the second regenerator 34 is smaller than the passage area of the high temperature side region 24. Therefore, according to the second regenerator 34, it is possible to obtain effects similar to those in the case where the insertion members 35 shown in FIGS. 4A to 4D are inserted.

In addition, the plurality of thin walled tubes 36 are accommodated to be distributed in the low temperature side region 25 of the second regenerator 34, and thus, it is possible to increase an area of a portion at which the thin walled tube 36 and the helium gas come into contact with each other. The thin walled tube 36 according to the embodiment in a high pressure state is filled with the helium gas which is the same as the helium gas which is the refrigerant gas. Accordingly, each of the thin walled tubes 36 also functions as the regenerator material. The area of the portion at which the thin walled tube 36 and the helium gas come into contact with each other is increased, and thus, efficiency of the heat exchange between the helium gas and the thin walled tube 36 is increased. As a result, the insertion member 35 configured of the plurality of thin walled tubes 36 can function as one regenerator material.

Pulse Tube Type Refrigerator

As above, the aspect in which the second regenerator 34 according to the embodiment is applied to the displacer type refrigerator is described. However, certain embodiments of the present invention may be applied to a pulse tube type refrigerator. Hereinafter, cases where certain embodiments of the present invention are applied to the pulse tube type refrigerator will be described.

Figure 6:
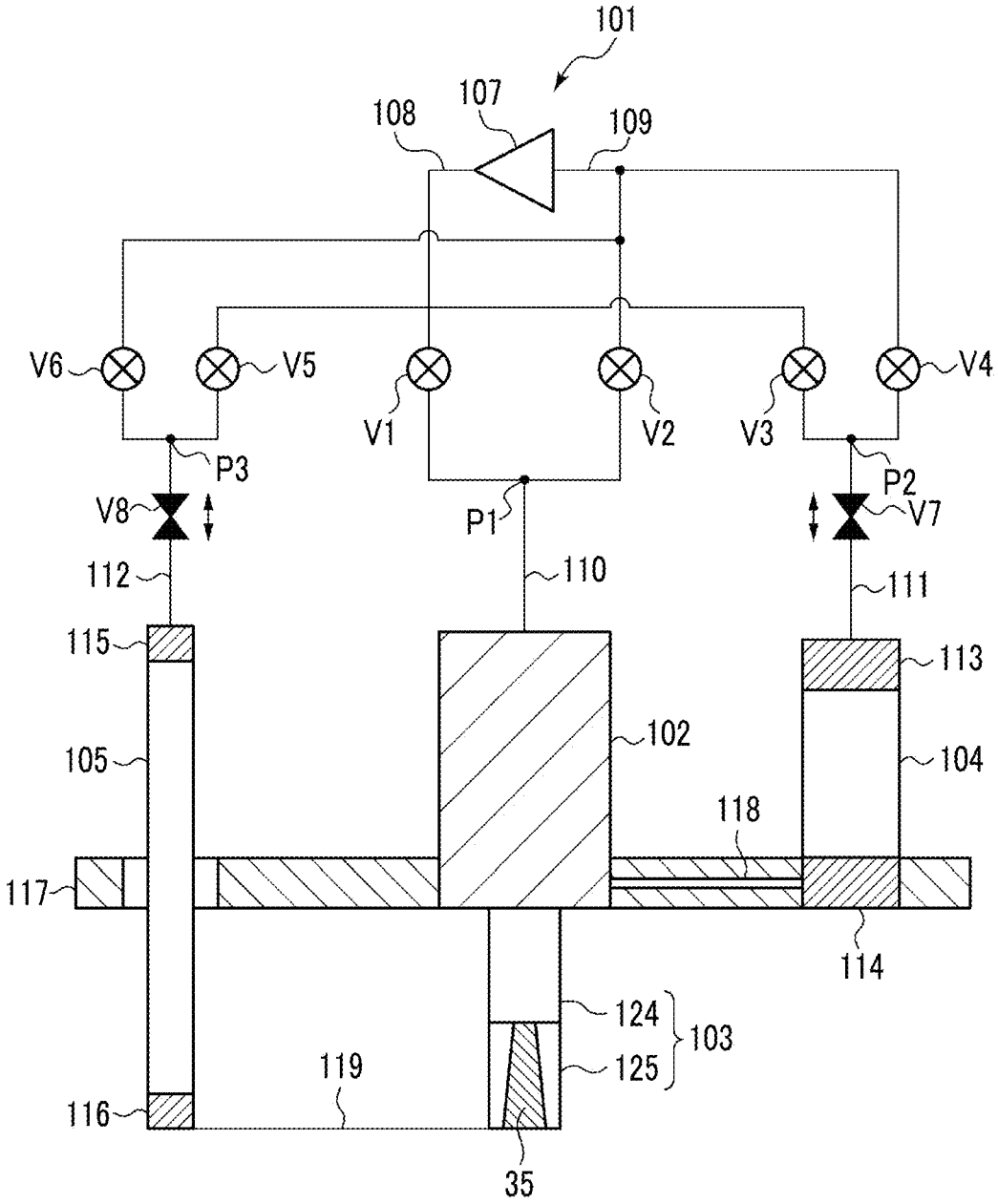
FIG. 6 is a diagram schematically showing a pulse tube type regenerative refrigerator.

FIG. 6 is a diagram schematically showing a pulse tube type regenerative refrigerator 101. As shown in FIG. 6, the pulse tube type regenerative refrigerator 101 includes a first regenerator 102, a second regenerator 103, a first pulse tube 104, and a second pulse tube 105. Each high temperature end of the first regenerator 102, the first pulse tube 104, and the second pulse tube 105 is connected to a branch pipe 108 which is branched to three segments from a discharge side of a compressor 107 and a branch pipe 109 which is branched to three segments from an intake side via a first supply and exhaust common pipe 110, a second supply and exhaust common pipe 111, and a third supply and exhaust common pipe 112 corresponding to each high temperature end.

A regenerator supply valve V1 is disposed at the front of a first connection point P1 of the branch pipe 108 to the first supply and exhaust common pipe 110. A first supply valve V3 is disposed at the front of a second connection point P2 of the branch pipe 108 to the second supply and exhaust common pipe 111. In addition, a second supply valve V5 is disposed at the front of a third connection point P3 of the branch pipe 108 to the third supply and exhaust common pipe 112.

A regenerator return valve V2 is disposed at the front of the first connection point P1 of the branch pipe 109 to the first supply and exhaust common pipe 110. A first return valve V4 is disposed at the front of the second connection point P2 of the branch pipe 109 to the second supply and exhaust common pipe 111. A second return valve V6 is disposed at the front of the third connection point P3 of the branch pipe 109 to the third supply and exhaust common pipe 112.

A flow rate control valve V7 is disposed between the high temperature end of the first pulse tube 104 of the second supply and exhaust common pipe 111 and the second connection point P2. In addition, a flow rate control valve V8 is disposed between the high temperature end of the second pulse tube 105 of the third supply and exhaust common pipe 112 and the third connection point P3. The flow rate control valves act as a phase adjustment mechanism of a gas piston generated in the pulse tube. In addition, instead of the flow rate control valve, an orifice may be used.

A first flow straightening heat exchanger 113 is disposed on the high temperature end of the first pulse tube 104, and a second flow straightening heat exchanger 114 is disposed on the low temperature end. A third flow straightening heat exchanger 115 is disposed on the high temperature end of the second pulse tube 105, and a fourth flow straightening heat exchanger 116 is disposed on the low temperature end.

The low temperature end of the first pulse tube 104 and the low temperature end of the first regenerator 102 are thermally connected to each other by a cooling stage 117. The low temperature end of the first pulse tube 104 and the low temperature end of the first regenerator 102 are connected to each other by a first low temperature end connection tube 118 positioned in the inner portion of the cooling stage 117 so that the refrigerant gas circulates. The low temperature end of the second pulse tube 105 and the low temperature end of the second regenerator 103 are connected to each other by a second low temperature end connection tube 119 so that the refrigerant gas circulates.

In addition, similar to the above-described displacer type second regenerator 34, in the pulse tube type regenerative refrigerator 101, a high temperature side region 124 including a nonmagnetic material at the upper stage, and a low temperature side region 125 including the regenerator material of the magnetic material at the lower stage are provided in the inner portion of the second regenerator 103. The high temperature side region 124 and the low temperature side region 125 are matched to each other, and thus, the second regenerator 103 is configured.

In the pulse tube type regenerative refrigerator 101 configured in this way, in a supply process of a high pressure refrigerant gas, if the first supply valve V3 and the second supply valve V5 are opened, the refrigerant gas flows into the low temperature ends of the first pulse tube 104 and the second pulse tube 105 via the branch pipe 108 and the second supply and exhaust common pipe 111 or the third supply and exhaust common pipe 112.

Moreover, if the regenerator supply valve V1 is opened, the refrigerant gas flows into the low temperature end of the first pulse tube 104 from the first regenerator 102 through the branch pipe 108 and the first supply and exhaust common pipe 110 from the compressor 107, and flows into the high temperature end of the second pulse tube 105 through the second regenerator 103.

Meanwhile, in a return process of a low pressure refrigerant gas, if the first return valve V4 or the second return valve V6 is opened, the refrigerant gas inside the first pulse tube 104 or the second pulse tube 105 is returned to the compressor 107 through the second supply and exhaust common pipe 111 or the third supply and exhaust common pipe 112 and the branch pipe 109 from each high temperature end. Moreover, if the regenerator return valve V2 is opened, the refrigerant gas inside the first pulse tube 104 is returned to the compressor 107 via the first regenerator 102, the first supply and exhaust common pipe 110, and the branch pipe 109 from the low temperature end. Similarly, the refrigerant gas inside the second pulse tube 105 is returned to the compressor 107 via the second regenerator 103, the first regenerator 102, the first supply and exhaust common pipe 110, and the branch pipe 109.

In the pulse tube type regenerative refrigerator 101, cooling is formed in the low temperature ends of the regenerators and pulse tubes by repeating the operation which causes the refrigerant gas such as helium gas which is a working fluid compressed by the compressor 107 to flow into the first regenerator 102, the second regenerator 103, the first pulse tube 104, and the second pulse tube 105, and the operation which causes the working fluid to flow out of the first pulse tube 104, the second pulse tube 105, the first regenerator 102, and the second regenerator 103 and to be covered to the compressor 107. Moreover, it is possible to cool a cooling object by causing the cooling object to come into thermal contact with the low temperature end.

Similar to the case of the second regenerator 34 in the above-described displacer type regenerative refrigerator 1, also in the pulse tube type regenerative refrigerator 101, it is possible to insert the insertion members 35 shown in FIGS. 4A to 5B into the low temperature side region 125 of the second regenerator 103. The effects are similar to those in the case of the displacer type regenerative refrigerator 1. In addition, FIG. 6 shows the aspect in which the insertion member 35 shown in FIG. 4A is inserted into the low temperature side region 125 of the second regenerator 103 in the pulse tube type regenerative refrigerator 101.

As described above, according to the second regenerator 34 and the second regenerator 103 of certain embodiments of the present invention, it is possible to decrease the used amount of the regenerator material while maintaining the freezing performance of the regenerative refrigerator.

As above, preferred embodiments of the present invention are described. However, certain embodiments of the present invention are not limited to the above-described embodiments, and various modifications and replacements may be applied to the above-described embodiment without departing from the scopes of certain embodiments of the present invention.

For example, in the above-described regenerative refrigerator, the double stage case is shown. However, the number of the stages may be appropriately selected to be three or more. Moreover, in the embodiment, the example in which the regenerative refrigerator is the displacer type GM refrigerator or the pulse tube type is described. However, certain embodiments of the present invention are not limited to this. For example, certain embodiments of the present invention may be applied to a Sterling refrigerator, a Solvay refrigerator, or the like.

It should be understood that the invention is not limited to the above-described embodiment, but may be modified into various forms on the basis of the spirit of the invention. Additionally, the modifications are included in the scope of the invention.

What is claimed is:

1. A regenerator which accumulates cooling generated by expansion of refrigerant gas, the regenerator comprising:

a regenerator material which is made of a nonmagnetic material;

a regenerator material which is made of a magnetic material;

a container which includes a high temperature end and a low temperature end, and which is configured to accommodate the regenerator material made of the nonmagnetic material at the high temperature end side and the regenerator material made of the magnetic material at the low temperature end side, wherein the container further accommodates an insertion member which narrows a passage area of the refrigerant gas flowing to a region accommodating the refrigerator material made of the magnetic material so that the passage area of the low temperature end side is narrower compared to the passage area of the high temperature end side, wherein the insertion member is configured so that the cross-sectional area is increased from one end toward the other end, and wherein the container accommodates the insertion member in the region accommodating the regenerator material made of the magnetic material so the one end of the insertion member is a high temperature side and the other end is a low temperature side.

2. A regenerator which accumulates cooling generated by expansion of refrigerant gas, the regenerator comprising:

a regenerator material which is made of a nonmagnetic material;

a regenerator material which is made of a magnetic material;

a container which includes a high temperature end and a low temperature end, and which is configured to accommodate the regenerator material made of the nonmagnetic material at the high temperature end side and the regenerator material made of the magnetic material at the low temperature end side, wherein the container further accommodates an insertion member which narrows a passage area of the refrigerant gas flowing to a region accommodating the refrigerator material made of the magnetic material so that the passage area of the low temperature end side is narrower compared to the passage area of the high temperature end side, wherein the insertion member is a tubular member in which a passage including a passage area decreased from one end toward the other end is provided, and is fitted to and inserted into the region of the container accommodating the regenerator material made of the magnetic material so that the one end is a high temperature side of the container and the other end is a low temperature side of the container, and wherein the regenerator material made of the magnetic material is accommodated in the passage provided in the insertion member.

3. The regenerator according to claim 1, wherein the insertion member is configured of a plurality of thin walled tubes, wherein a length in a long axis direction of each of the plurality of thin walled tubes is shorter than a length in a long axis direction of the region of the container accommodating the regenerator material made of the magnetic material, and wherein the container accommodates the plurality of thin walled tubes to be distributed in a low temperature side of the region accommodating the regenerator material made of the magnetic material.

4. The regenerator according to claim 1, wherein the insertion member is made of a phenol resin.

5. The regenerator according to claim 3, wherein each of the plurality of thin walled tubes configuring the insertion member is filled with a gas of the same kind as the refrigerant gas.

6. A regenerative refrigerator comprising:

a regenerator according to claim 1; and a compressor which supplies a high pressure refrigerant gas to the regenerator and compresses a low pressure refrigerant gas returned from the regenerator.

7. The regenerator according to claim 2, wherein the insertion member is made of a phenol resin.

8. A regenerative refrigerator comprising:

a regenerator according to claim 2; and a compressor which supplies a high pressure refrigerant gas to the regenerator and compresses a low pressure refrigerant gas returned from the regenerator.

* * * * *